US006487953B1

(12) United States Patent
McIngvale

(10) Patent No.: US 6,487,953 B1
(45) Date of Patent: Dec. 3, 2002

(54) FIRE CONTROL SYSTEM FOR A SHORT RANGE, FIBER-OPTIC GUIDED MISSILE

(75) Inventor: Pat H. McIngvale, Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 06/754,891

(22) Filed: Apr. 15, 1985

(51) Int. Cl.[7] ..... F41G 5/06; F41G 7/00
(52) U.S. Cl. ..... 89/41.05; 244/3.16; 244/3.17
(58) Field of Search ..... 244/3.12, 3.11, 244/3.14, 3.15, 3.16, 3.19, 3.17; 89/41.05

(56) References Cited

U.S. PATENT DOCUMENTS

| | | | | |
|---|---|---|---|---|
| 3,217,097 A | | 11/1965 | Pauli et al. | 178/6 |
| 3,233,847 A | * | 2/1966 | Girsberger | 244/3.12 |
| 3,371,887 A | * | 3/1968 | Welti | 244/3.11 |
| 3,715,953 A | * | 2/1973 | Allan | 244/3.16 |
| 3,718,293 A | | 2/1973 | Willems et al. | 244/3.16 |
| 3,743,215 A | | 7/1973 | Harris | 244/3.14 |
| 3,753,538 A | * | 8/1973 | Marsh et al. | 244/3.12 |
| 3,778,007 A | * | 12/1973 | Kearney, II et al. | 244/3.14 |
| 3,844,506 A | * | 10/1974 | Stavis et al. | 244/3.15 |
| 3,995,792 A | | 12/1976 | Otto et al. | 244/3.14 |
| 4,003,659 A | | 1/1977 | Conrad et al. | 356/152 |
| 4,004,487 A | * | 1/1977 | Eichweber | 244/3.15 |
| 4,047,678 A | | 9/1977 | Miller et al. | 244/3.14 |
| 4,093,153 A | | 6/1978 | Bardash et al. | 244/3.14 |
| 4,097,007 A | | 6/1978 | Fagan et al. | 244/3.11 |
| 4,143,835 A | | 3/1979 | Jennings et al. | 244/3.11 |
| 4,198,015 A | | 4/1980 | Yates et al. | 244/3.15 |
| 4,244,029 A | | 1/1981 | Hogan et al. | 364/728 |
| 4,247,059 A | | 1/1981 | Duke et al. | 244/3.16 |
| 4,267,562 A | * | 5/1981 | Raimondi | 89/41.05 |
| 4,277,038 A | | 7/1981 | Yates et al. | 224/3.15 |
| 4,386,848 A | * | 6/1983 | Clendenin et al. | 244/3.16 |

OTHER PUBLICATIONS

"A Glimpse at FOG–M"; *Army Research Development & Acquisition Magazine*; Jan.–Feb. 1984; p. 3.*

* cited by examiner

*Primary Examiner*—Charles T. Jordan
(74) *Attorney, Agent, or Firm*—Arthur H. Tischer; Freddie M. Bush

(57) ABSTRACT

A fire control system for a short range guided missile in which the system is contained on a vehicle such as a track vehicle that can be easily camouflaged from the enemy and including video means for acquiring a target desired to be destroyed and utilizing this video information as reference information in an automatic target handoff correlator which correlates the reference information from video signals from a missile that was launched from the vehicle and guided by a missile control computer to the field of view of the selected target with the automatic target handoff correlator comparing the reference video signals and the seeker video signals from the missile to place the target in the center of the field of view of the seeker and once this is done a missile autotracker is commanded to lock-on and guide the missile to the selected target.

5 Claims, 2 Drawing Sheets

FIRE CONTROL SYSTEM FOR A SHORT RANGE, FIBER-OPTIC GUIDED MISSILE

DEDICATORY CLAUSE

The invention described herein may be manufactured, used, and licensed by or for the Government for governmental purposes without the payment to me of any royalties thereon.

BACKGROUND OF THE INVENTION

In the past, various approaches have been advanced of weapon systems in a close combat situation. Also the systems have not always been self contained and/or capable of solving complex problems with command, control, and coordination. Therefore, it can be seen that there is a need for a system that is self contained and has the capability of solving problems with command, control and coordination from a concealed position. Also, there is a need of a system which can make multiple target engagements in a short period of time and still remain in a concealed position or environment.

Therefore, it is an object of this invention to provide a missile system for a short range fiber-optic guided missile that can effectively function from a concealed position.

Another object of this invention is to provide a fire control system that can accurately detect a target and accurately fire and control a missile to a point of impact with the target.

Another object of this invention is to provide a fire control system that is readily usable from a concealed position on close combat targets.

Other objects and advantages of this invention will be obvious to those skilled in this art.

SUMMARY OF THE INVENTION

In accordance with this invention, a fire control system for short range, fiber-optic guided missiles is disclosed in which a vehicle which can be hidden from potential targets has a mast mounted target acquisition system that is controlled by an operator from the vehicle to locate a target, confirm that the target is actually a target, and center the target in the field of view and begin tracking of the target. Once the gunner or operator recognizes a target and makes a decision to attack, a fire command is initiated by the operator which feeds heading information into a missile control computer and feeds reference video information from the target acquisition system to an automatic target handoff correlator which stores this reference video information in its memory. The missile control computer then fires a fiber-optic guided missile vertically and the missile control computer uses the heading information to cause the missile to fly a predetermined trajectory and be directed into the field of view of the target. The missile has a seeker in the nose thereof that will be looking in the direction of the target when guided by the missile control computer through signals transmitted through the fiber-optic connection. With the seeker looking at the target area, the missile seeker which is a video seeker transmits its video information through fiber-optic link to the missile control computer and the automatic target handoff correlator which compares the video information from the seeker to that stored in its reference memory to find the point on the "live" image from the seeker that best matches the reference video information. The automatic target handoff correlator then generates signals for correcting the positioning of the seeker and the missile. This information from the automatic target handoff correlator is provided to the missile control computer that sends signals over the fiber-optic to the missile to cause the seeker to be directed so that the target is centered in the field of view of the seeker. Once is the target is in the center of the field of view of the missile seeker, the automatic target handoff correlator then sends a signal to a missile autotracker that takes over and maintains the missile on course to impact with the target. The system also provides for multiple engagements by utilizing multiple missiles and multiple missile autotrackers.

DESCRIPTION OF THE PREFERRED EMBODIMENT

Figure 1:
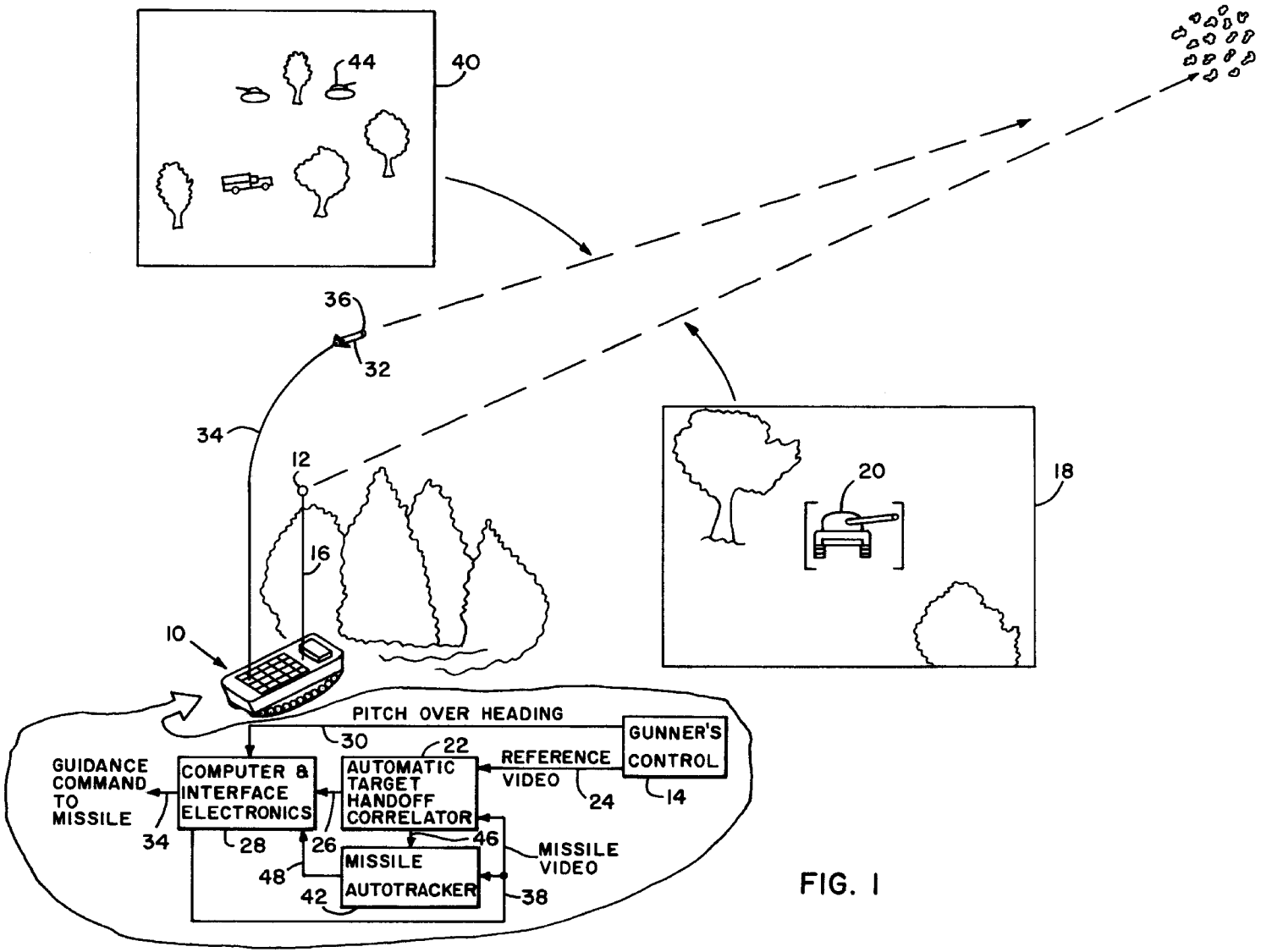
FIG. 1 is a schematic and pictorial view of a fire control system in accordance with this invention.
Figure 2:
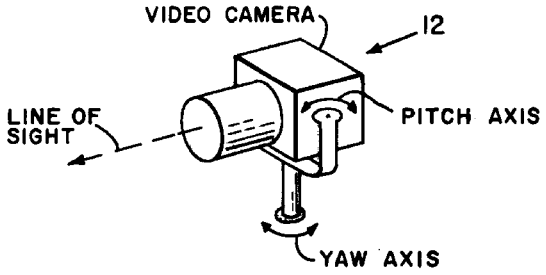
FIG. 2 is a schematic illustration of a video camera.
Figure 3:
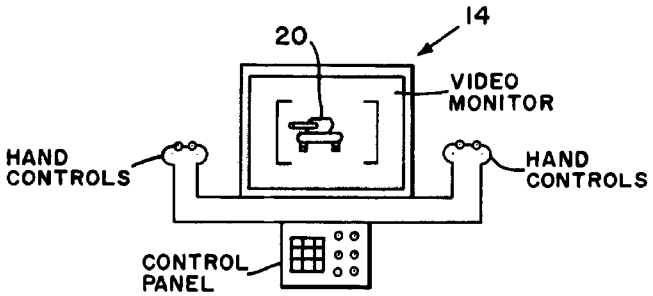
FIG. 3 is a schematic sketch of a gunner's control and display.
Figure 4:
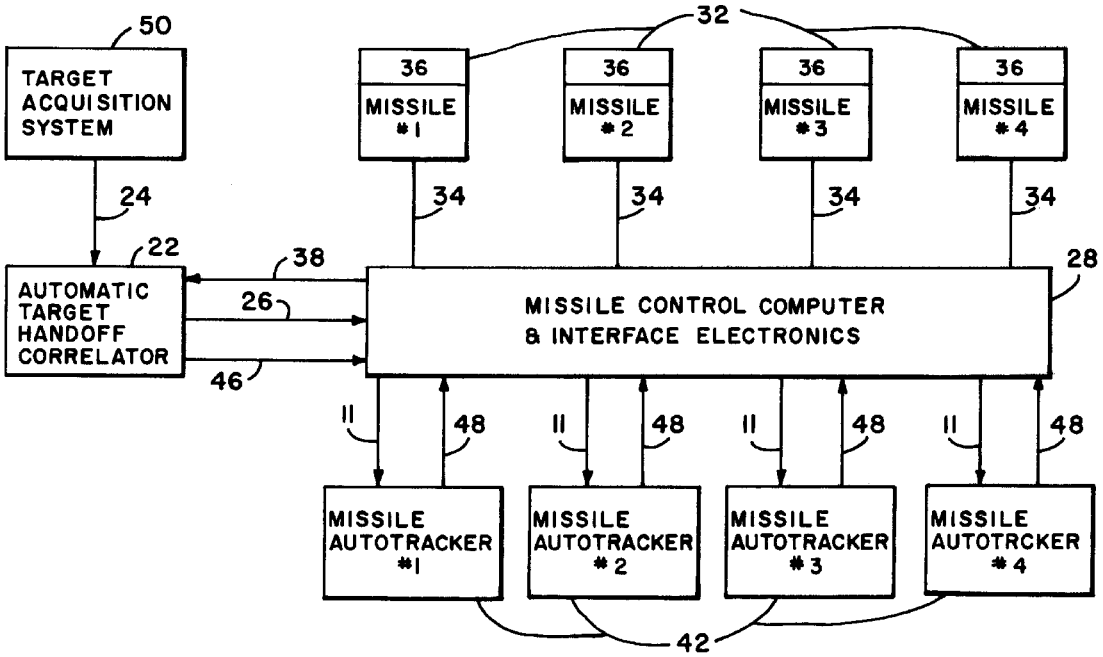
FIG. 4 is a schematic block diagram illustrating a multi-target and rapid fire system arrangement.

Referring now to the drawings, a fire control system in accordance with this invention is illustrated and includes a vehicle 10 on which is mounted a video target acquisition system that includes a mast mounted video acquisition camera system 12 such as schematically illustrated in FIG. 2 and a gunner's control 14 such as schematically illustrated in FIG. 3. Video camera 12 is mounted on a mast 16 as illustrated in FIG. 1 to allow the fire control system to be concealed from the enemy and therefore hidden from potential targets so its vulnerability can be minimized. This target acquisition system can either be a television sensor and/or an imaging infrared sensor which presents to the operator/gunner a magnified, stabilized view of a target area such as illustrated at 18 and on the gunner's video monitor screen of gunner's control 14. Using this magnified scene, the gunner locates a potential target, confirms that it is a target and centers the target such as illustrated at 20 in the field of view and begins tracking it. Target detection and recognition can be performed manually in a near term system as depicted here or as development of automatic target cuer/recognizer systems progress, one of these systems could be used.

Gunner's control station 14 is connected through connection 24 to automatic target handoff correlator 22 and at the command of the gunner the reference video information of the target desired to be destroyed is transmitted from the gunner's control through connection 24 to automatic target handoff correlator 22. The automatic target handoff correlator 22 stores this reference video information. Automatic target handoff correlator 22 is a device that compares digitized video information images to find the point on a "live" image that best matches the reference image. To perform this function, the automatic target handoff correlator normally digitizes both images, performs noise cleaning, shrinks the image having the highest magnification to make it the same size as the reference image, performs other edge enhancement, and finally cross-correlates the two images for comparison in a correlation circuit to insure that the images are the same target. Such an automatic target handoff correlator of this type is disclosed in U.S. Pat. No. 4,244,029 issued Jan. 6, 1981 to Hogan et al. Automatic target handoff correlator 22 is connected through connection 26 to a missile control computer and interface electronics 28. Gunner's control 14 is innerconnected through connection 30 to missile control computer 28 to provide pitch over heading information from the gunner's control to the computer to allow the computer to provide a preprogramed initial flight path for a missile. Also, connection 30 can automatically provide the signal to computer 28 for firing a missile such as missile 32 or a separate fire signal can be utilized. In this system, a fiber-optic communication link 34 is connected between missile 32 and computer 28. This communication link 34 is provided for communicating signals from computer 28 to missile 32 to guide the missile in a predetermined flight for the first portion of the flight of missile 32. Missile 32 has a video seeker 36 in the nose thereof and "live" video signals gathered by video seeker 36 are transmitted through communication link 34 to computer 28. As can be appreciated, utilizing a communication link 34 such as a fiber or metal optic link, vehicle 10 with computer 28 thereon does not have to be in the line of sight with missile 32. Video signals from seeker 36 are therefore transmitted through optic link 34, computer 28 and through connection 38 to provide "live" image video of the target such as illustrated at 40 to automatic target handoff correlator 22 and also into the input of missile autotracker 42. The live video information provided by seeker 36 to automatic target handoff correlator 22 through connection 38 is processed by the automatic target handoff correlator to locate target 44 which corresponds to target 20. Automatic target handoff correlator 22 produces signals that are transmitted through connection 26 to computer 28 which acts on these signals to adjust missile 32 and seeker 36 to place target 44 in the center of the field of view of seeker 36. Once this has been accomplished, correlator 22 recognizes that target 44 has been centered in the field of view and sends a signal through connection 46 to missile autotracker 42 and causes missile autotracker 42 to be locked on the target. Missile autotracker 42 receives the information from seeker 36 from the very beginning of signals being communicated from seeker 36 to automatic target handoff correlator 22 and missile autotracker 42, but missile autotracker 42 does not take control until the proper signal is transmitted through connection 46. Missile autotracker 42 now communicates through connection 48, control computer 28, and communication link 34 to the missile for controlling flight of missile 32 to cause it to impact with the selected target.

In operation, when it is desired to destroy an enemy target, track vehicle 10 is moved into a camouflaged position from the enemy and a gunner/operator at track vehicle 10 operates controls on vehicle 10 in a conventional manner to direct video camera 12 to locate a target that is desired to be destroyed. This target is centered in the field of view of the screen of video monitor 14 by the operator and when the operator decides to fire upon the selected target, the reference video information signals are fed from gunner control 14 through connection 24 to automatic target handoff correlator 22 which stores this video as a reference of the target desired to be destroyed. At the same time, heading signals are sent by the gunner from gunner control 14 through line 30 to missile control computer and interface electronic 28 to fire missile 32 vertically and guide the missile through data link 34 which is connected to missile 32 and computer 28. When missile 32 has been caused to pitch over from the vertical position to where the target is now in the field of view of seeker 36, seeker 36 transmitts its "live" video information through data link 34 to computer 28 and from computer 28 through connection 38 to automatic target handoff correlator 22 which compares the "live" video from seeker 36 with that of the reference video. From the correlation of these two videos, automatic target handoff correlator 22 produces a signal for additional correction that is transmitted through connection 26 to computer 28 and computer 28 in turn causes correction of missile 32 and seeker 36 to bring the desired target into the center of the field of view of seeker 36. Information is fed back and forth from seeker 36 and automatic target handoff correlator 22 until the target is in the center of the field of view. When this has been accomplished, automatic target handoff correlator 22 sends a signal through connection 46 to missile autotracker 42 that has been receiving the same signals as automatic target handoff correlator 22 but not exerting control over the missile until the command signal is given by automatic target handoff correlator 22 through connection 46. Missile autotracker 42 then takes over or locks-on and guides missile 32 through computer 28 and link 34 to direct missile 32 to impact with the selected target.

Referring now to FIG. 2 a multi-target, rapid fire capability, system is described which contains the same elements of FIGS. 1 through 3, but this figure is drawn in block diagram form to more clearly describe the rapid engagement capability of this fire control system against multiple targets. Target acquisition system 50 is the same as elements 12, 14, and 16 of FIG. 1 with which the gunner scans the battlefield, locates and tracks targets. Automatic target handoff correlator 22 is the same as described earlier with reference to FIG. 1. Inputs to automatic target handoff correlator 22 are reference video through line 24 and seeker "live" video through line 38. Outputs from automatic target handoff correlator 22 are of seeker slewing commands through connection 26 and autotrack lock-on commands through connection 46 to computer 28, connections therein and connection 11 to missile autotracker No. 1. This arrangement utilizes a multiplicity of missiles 32 each having a TV or imaging IR seeker as its video seeker 36 that is connected to computer 28 on the launch vehicle VIA data link 34 such as a fiber-optic link over which video signals travel from the missile to the ground vehicle and control signals travel from the ground to the missile in the same manner as described for FIG. 1. There is no specific limit as to the number of missiles that can be controlled using this fire control system. Nearly all signals go through the combination missile interface electronics and missile control computer 28 in the same manner as described in FIG. 1 except this control handles a multiplicity of autotrackers numbered 1 through 4 and a multiplicity of missiles numbered 1 through 4 also. Finally, missile autotrackers 42 which take missile seeker video through connection 11 and generate missile control signals that are transmitted through connection 48 to computer 28 providing that the target of interest is first placed in the center of the seeker field-of-view. As will be appreciated, the number of autotrackers can be less than the number of missiles since the autotrackers can be used over and over with different missiles.

In operation, the same sequence as described in conjunction with FIG. 1 takes place until the first target is within the center of the field-of-view of the first seeker. At that time, the automatic target handoff correlator 22 commands the first autotracker 42 to begin tracking the target and guiding its assigned missile. As soon as autotracker locks-on, a signal is given to the gunner at his control panel to alert him that he can initiate an attack on another target. He can then send acquisition reference video of another target and initiate the attack sequence on another target. In a target enriched environment, there can be many missiles in the air at a time since target location, missile launch, and lock-on sequence only requires a few seconds. Depending upon the speed of the missiles and the speed of the gunner, an optimum number of autotrackers can be determined so that the last autotracker is assigned to a target just as the first missile impacts the first selected target. Once the first target has been impacted, the first autotracker is made available for another missile. A logical variation of this system could be where the missile autotracker is made a part of the electronics on board the missile rather than the ground vehicle. However, this variation would cause the missile round to be more expensive and the missile autotracker would be destroyed each time it is used. However, with this variation, once the automatic target handoff correlator transferes the missile tracking function to the autotracker, the optical link such as the fiber-optic can be cut and the missile can fly automatically on its own to the target. This arrangement requires extra electronics in the missile, but the fiber-optic bundle can be made shorter and the missile can be flown independently of the ground vehicle as soon as it locks-on the target and begins autotracking.

Because this entire system can be self contained, there are no complex problems with command, control, and coordination. Furthermore, with this system it is not necessary to know the exact vehicle location since targets are only engaged when the gunner acquires them in his target acquisition system. This also makes the system a versatile system in a close combat situation which can engage multiple targets in a short time while remaining in a concealed environment.

The individual components of this fire control system are known and available for assembly. However the arranging of the components in a unique fire control system are not known. The arranging of the components in a unique fire control arrangement as done here to provide an automated system capable of engaging many armored targets in a very short span of time from a position of concealment is not known and is very unique. This automated system provides a very effective weapon system for short range, close support and anti-armor scenario.

I claim:

1. A fire control system for short range guided missiles, comprising a transport means that can be positioned in a camouflaged environment from targets desired to be destroyed, said transport means having said fire control system mounted thereon and including video camera means mounted for observing targets from a camouflaged position, said video camera being connected to a gunner's control and said gunner's control connected to an automatic target handoff correlator for providing reference video of a selected target from the gunner's control to the automatic target handoff correlator, said automatic target handoff correlator being connected to a missile control computer and innerface electronics, said gunner's control also being connected to said missile control computer and providing signals of the heading of a selected target to be destroyed relative to said transport means, said missile control computer being connected for controlling launching of a missile for launching of said missile in a vertical direction and providing pre-program guidance to the missile through a data link between the computer and the missile to cause the missile to be pitched into the field of view of the selected target, said missile having a video seeker therein that provides video signals of the target through said data link to said missile control computer and to said automatic target handoff correlator which compares the video signals from the missile seeker to those of the reference video signals and produces an output that is communicated to said missile control computer for causing the missile control computer to adjust the missile and seeker until the selected target is centered in the field of view of the missile seeker, said automatic target handoff correlator then commanding an autotracker through a connection to the autotracker to cause the autotracker which is connected to the missile control computer and through the missile control computer to said data link to cause said missile to be guided by said autotracker to the selected target.

2. A fire control system for short range guided missiles as set forth in claim 1, wherein said data link between said missile and said missile control computer is a fiberoptic link, said video camera is a TV type camera and said missile seeker is a TV type seeker.

3. A fire control system for short range guided missiles as set forth in claim 1, wherein said fire control system is completely automatic except for a single operator that operates said gunner's control.

4. A fire control system for short range guided missiles as set forth in claim 1, wherein there are a multiplicity of missiles and a multiplicity of missile autotrackers with an autotracker assigned to a given missile, and said automatic target handoff correlator being connected to said missile control computer such that said automatic target handoff correlator can be shared with each of the multiplicity of missiles and missile autotrackers as first and succeeding missile autotrackers locks-on and takes control of their respectively assigned missile.

5. A method of operating a fire control system for short range guided missiles that has a camouflaged video target acquisition system, an automatic target handoff correlator, missile control computer and interface electronics, missile autotracker means, missiles with video seekers therein, and a data link between each missile and said missile control computer, said method comprising directing said video camera of said target acquisition system onto a desired target to be destroyed, centering said target in a video monitor of the target acquisition system, communicating a reference video signal of the target from the target acquisition system to the automatic target handoff correlator and storing as a reference video, communicating heading of the selected reference target information to the missile control computer, directing said missile control computer to cause firing of a missile and guidance of the missile to a field of view of the selected target, directing said video seeker of the missile to pickup the field of view of the selected target and transmit the video scene through said data link to said missile control computer and to said automatic target handoff correlator, correlating the video signals from said seeker with said reference video signals in said automatic target handoff correlator, producing correction signals that are transmitted to the missile control computer which directs correction of the missile and seeker to place the seeker in the center of the field of view of the selected target, sending a command signal from said automatic target handoff correlator to said missile autotracker and causing said missile autotracker to lock-on to said missile and guide said missile, and directing said missile by said missile autotracker to said selected target.

* * * * *